United States Patent [19]

Duinker et al.

[11] 3,947,608

[45] Mar. 30, 1976

[54] METHOD OF MANUFACTURING AN ELECTRICALLY CONDUCTING LAYER ON AN INTERNAL WALL PART OF A CATHODE-RAY TUBE

[75] Inventors: Hans Dignus Duinker; Jan Francis Cornelis Maria Wijnen, both of Eindhoven, Netherlands

[73] Assignee: U. S. Philips Corporation, New York, N.Y.

[22] Filed: Nov. 1, 1974

[21] Appl. No.: 520,032

[30] Foreign Application Priority Data

Nov. 26, 1973 Netherlands ..... 7216104

[52] U.S. Cl. ..... 427/64; 427/66; 427/73; 427/105; 427/106; 427/122; 427/230; 427/372; 427/376

[51] Int. Cl.[2] ..... B05D 5/06; B05D 5/12

[58] Field of Search ..... 117/223, 224, 226, 97, 117/201; 427/105, 106, 64, 66, 73, 164, 230, 165, 372, 376

[56] References Cited

UNITED STATES PATENTS

| | | | |
|---|---|---|---|
| 2,223,924 | 12/1940 | Stephan | 117/97 |
| 2,264,892 | 12/1941 | Schaefer | 117/226 |
| 2,699,510 | 1/1955 | Smelt | 117/224 |
| 2,818,355 | 12/1957 | Hesemans | 117/226 |
| 3,518,116 | 6/1970 | Stock et al. | 117/226 |

*Primary Examiner*—Michael F. Esposito
*Attorney, Agent, or Firm*—Frank R. Trifari; George B. Berka

[57] ABSTRACT

A method of manufacturing an electrically conducting layer on an internal wall part of a cathode-ray tube wherein by the addition of an alkali or ammonium sulphate or nitrate to a suspension consisting of a conducting material and a binder, a suspension is obtained which, upon drying on the wall, provides a layer in which substantially no gas bubbles are formed during the firing of the tube.

6 Claims, 1 Drawing Figure

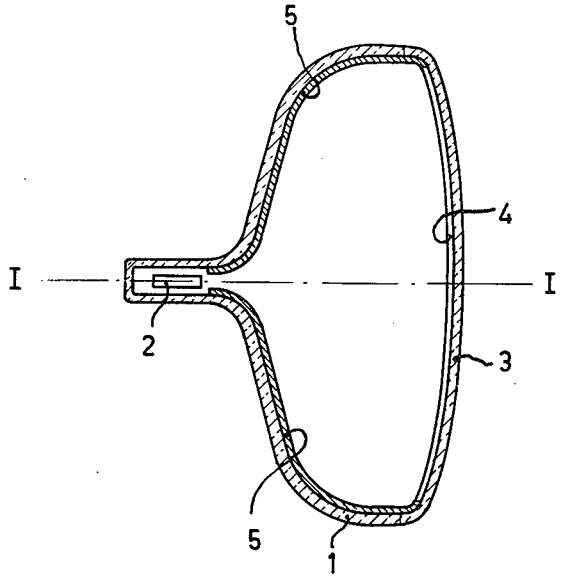
5
4
I
I
2
3
5
1

METHOD OF MANUFACTURING AN ELECTRICALLY CONDUCTING LAYER ON AN INTERNAL WALL PART OF A CATHOD-RAY TUBE

The invention relates to a method of manufacturing an electrically conducting layer on an internal wall part of a cathode-ray tube comprising the following steps: (1manufacturing a suspension comprising at least an electrically conductive material and a binder as well as an addition to influence the adhesion, the hardness and the resistance against shrinkage and wear; (2) providing a layer of the said suspension on the wall part; 3) drying the layer of the said suspension and firing the cathode-ray tube.

The invention also relates to a cathode-ray tube manufactured according to said method.

Such a method of manufacturing an electrically conducting layer on an internal wall part of a cathode-ray tube is known from the published Dutch patent application Ser. No. 6,608,315. A cathode-ray tube manufactured according to said method comprises in an evacuated envelope a configuration of electrodes for generating one or several electron beams, a display screen on an internal wall part of the envelope and the said electrically conductive layer. In such cathode-ray tubes said layer is obtained by providing the said suspension on an internal part of the wall of the cathode-ray tube by means of a brush, by pouring or spraying it on it. The layer is then dried With hot air and the cathode-ray tube is fired. In most cases said layer forms a conductive layer between an anode of the said configuration of electrodes and the display screen. The latter serves as a target for the said electron beams and hence obtains the character of a second anode. An electric connection to the anode of the said configuration of electrodes is often made via a lead-through in the tube wall of the cathode-ray tube and the said layer. The object of the said layer is also to create a field-free space in a region of the cathode-ray tube where the electron beams are not deflected. The said layer is usually dull black so that thermal energy is optimally radiated which is in favour of the thermal management in the cathode-ray tube.

An important condition which is imposed upon the said electrically conducting layer is that during assembly and the use of the cathode-ray tube no separate parts of the material of the layer are formed. Said separate parts may be formed, for example, in that gas bubbles formed in the layer during the firing of the cathode-ray tube, are fractured during the assembly. Actually, said separate parts may interrupt the path of the said electron beams and hence be a cause of picture defects. Breakdowns and shortcircuits may also occur in the said configuration of electrodes. The behaviour of the said layer may be influenced according to the published Dutch patent application Ser. No. 6,608,315 by adding organo-metal compounds to the suspension so that an improved adhesion, hardness and resistance to shrinkage and wear is achieved.

It is an object of the invention to provide an improved method of manufacturing an electrically conducting layer on an internal wall part of a cathode-ray tube. Another object of the invention is to obtain a layer which does not produce any separate parts in the said cathode ray tube both during use and during assembling the cathode ray tube. Still another object of the invention is to provide an addition for the said suspension which infuences the adhesion, hardness and flexibility of the said layer and moreover prevents the formation of gas bubbles during the firing of the cathode ray tube in the layer.

Accordng to the invention, a method of the type mentioned in the first paragraph is characterized in that the said addition to infuence the adhesion, hardness and resistance to shrinkage and wear consists of one or several inorganic salts of the group of alkali and ammonium sulphates and alkali and ammonium nitrates.

The insight in the mechanism which occurs during the action of said salts is not complete. It is known indeed that the layer obtains a flexible character and has a porous structure so that the formation of gas bubbles during firing the cathode-ray tube is prevented.

In a method of manufacturing an electrically conductive layer on an internal wall part of a cathode ray tube, the said addition to the suspension consists preferably of sodium nitrate. A few advantages of sodium nitrate are: (1) that it disintegrates upon firing, in which oxygen is released which oxidises contaminations in the tube and thus stimulates the degassing: (2) that nitrates are generally cheaper than the organo-metal compounds known from the prior art. Good results are obtained if from 1 to 10 % by weight of the solid part of the said suspension consists of alkali or ammonium sulphate or alkali and ammonium nitrate. There is an optimum effect if 4% by weight of the solid part of the said suspension consists of sodium nitrate.

The invention will be described in detail with reference to the accompanying drawing which shows a cathode-ray tube manufactured according to the invention. It comprises an envelope 1 in which a configuration of electrodes 2 for generating at least one electron beam, a display screen 3 constructed from a fluorescent layer 4 and an electrically conducting layer 5 on the inner wall of the envelope 1 are present. I—I is the axis of the cathode-ray tube. The lining layer can be obtained, for example, as folllows. An aqueous suspension in which 20–30 % by weight of graphite powder as a conducting material, 10–15 % by weight of an alkali metal silicate, for example potassium silicate, as a binder, and 4 % by weight of sodium nitrate, completed to 100 % with water, is obtained by thorough mixing. The resulting suspension is provided on at least a part of the inner wall of the envelope by means of a brush, by spraying or pouring. The layer is then dried after which the cathode-ray tube traverses in a furnace a temperature range in which temperatures up to 450°C occur. The layer hardens and adheres to the surface of the envelope, shows no unevenesses caused by gas bubbles in the layer and has a sufficiently large flexibility so that no separate parts are formed in said cathode-ray tube during assembly and during the use of the cathode-ray tube. Another possibility of obtaining an good suspension is to mix 150 g of iron oxide ($Fe_2O_3$) with 30 g of graphite. This mixture is the electrically conducting material. Added to said mixture as a binder are 150 g of alkali metal silicate, for example, potassium silicate and as an addition 4 g of sodium nitrate ($Na\ NO_3$). 170 Ml of water are added to the whole. An electrically conducting layer can be obtained from this suspension in a manner analogous to the method described.

What is claimed is:

1. A method of manufacturing an electrically conducting layer on an internal wall part of a cathode-ray tube comprising the steps of: (1) manufacturing a suspension comprising at least an electrically conducting material and a binder as well as an addition consisting of one or a mixture of more than one inorganic salt selected from the group of alkali and ammonium sulphates and alkali and ammonium nitrates, to infuence the adhesion, the hardness and the resistance against shrinkage and wear of said material; (2) providing a layer of the said suspension on the wall part; and (3) drying the layer of the said suspension and firing the cathode-ray tube.

2. A method as claimed in claim 1, wherein 1% to 10 % by weight of the solid part of the said suspension consists of the said inorganic salts.

3. A method as claimed in claim 1 wherein said addition is sodium nitrate.

4. A method as claimed in claim 3, wherein substantially 4% by weight of the solid part of the said suspension consists of sodium nitrate.

5. A method as claimed in claim 1, wherein said electrically conducting material is graphite.

6. A method as claimed in claim 1, wherein said electrically conducting material is a mixture of iron oxide with grahite.

* * * * *

UNITED STATES PATENT AND TRADEMARK OFFICE

CERTIFICATE OF CORRECTION

PATENT NO. : 3,947,608

DATED : March 30, 1976

INVENTOR(S) : HANS DIGNUS DUINKER ET AL

It is certified that error appears in the above-identified patent and that said Letters Patent are hereby corrected as shown below:

On the title page, Section [30] change "7216104" to --7316104--.

Column 1, line 10, change "(1" to --1)--;

line 31, change "With" to --with--.

Column 2, line 56, change "an" to --a--.

Signed and Sealed this twenty-second Day of June 1976

[SEAL]

*Attest:*

RUTH C. MASON
*Attesting Officer*

C. MARSHALL DANN
*Commissioner of Patents and Trademarks*